United States Patent [19]

Satomura

[11] Patent Number: 4,628,183

[45] Date of Patent: Dec. 9, 1986

[54] HEATING-FIXING ROLLER AND FIXING DEVICE HAVING THE SAME

[75] Inventor: Hiroshi Satomura, Saitama, Japan

[73] Assignee: Canon Kabushiki Kaisha, Tokyo, Japan

[21] Appl. No.: 681,676

[22] Filed: Dec. 14, 1984

[30] Foreign Application Priority Data

Dec. 19, 1983 [JP] Japan ..... 58-237838

[51] Int. Cl.[4] ..... G03G 15/20; H05B 3/10

[52] U.S. Cl. ..... 219/216; 219/505; 219/469; 355/3 FU; 432/60

[58] Field of Search ..... 219/216, 469, 470, 471, 219/504, 505; 355/3 FU; 432/227, 228, 59, 60

[56] References Cited

U.S. PATENT DOCUMENTS

| | | | |
|---|---|---|---|
| 4,034,207 | 7/1977 | Tamada | 219/504 |
| 4,162,395 | 7/1979 | Kobayashi | 219/504 |
| 4,213,031 | 7/1980 | Färber | 219/471 |
| 4,266,115 | 5/1981 | Dannatt | 219/216 |
| 4,395,109 | 7/1983 | Nakajima | 219/469 |

FOREIGN PATENT DOCUMENTS

| | | | |
|---|---|---|---|
| 0019491 | 11/1980 | European Pat. Off. | 219/471 |
| 56-138766 | 10/1981 | Japan | 219/469 |
| 59-42571 | 3/1984 | Japan | 355/3 FU |

*Primary Examiner*—L. A. Goldberg
*Assistant Examiner*—Teresa J. Walberg
*Attorney, Agent, or Firm*—Fitzpatrick, Cella, Harper & Scinto

[57] ABSTRACT

A heating-fixing roller has over the axial direction thereof a heat-generating layer formed via the step of mixing a raw material capable of obtaining a positive temperature coefficient of resistivity characteristic by baking and a binder for holding the raw material and forming an unbaked annular substrate and the step of providing an electrode to which an applied voltage is supplied on the mixture during the forming step, and thereafter via the step of baking the unbaked annular substrate on which the electrode is formed. The heat-generating layer has a positive temperature coefficient of resistivity characteristic after the baking and has the electrode formed on the surface thereof.

26 Claims, 6 Drawing Figures

HEATING-FIXING ROLLER AND FIXING DEVICE HAVING THE SAME

BACKGROUND OF THE INVENTION

1. Field of the Invention

This invention relates to a heating-fixing roller of a fixing device applied to a recording apparatus such as an electrophotographic copying apparatus, a printer or a facsimile apparatus. This invention also relates to a heating-fixing roller as heating means utilized for the fixation of unfixed images.

2. Description of the Prior Art

The heating-fixing roller heretofore put into practical use, has a temperature detector on the surface thereof and is temperature-controlled by changing over a halogen heater provided at the center of the interior of the roller to its electrically energized condition or its electrically non-energized condition.

This temperature control is considerably complicated and therefore, heating-fixing rollers utilizing ceramics of a positive temperature coefficient of resistivity (hereinafter referred to as PTC) characteristic having a self temperature control function have been proposed.

U.S. Pat. No. 4,266,115 discloses a heating-fixing roller using bar-like semiconductor ceramics having the PTC characteristic and formed to have bar like shape. However, the bar-like shaped PTC ceramics are thick and therefore must be provided on the inner surface of the roller in greatly spaced apart relationship with one another. Therefore, in the roller disclosed in U.S. Pat. No. 4,266,115, the surface layer of the roller heated by the ceramics assumes a non-uniform temperature distribution and causes unsatisfactory fixation.

Also, the PTC ceramics disclosed in said U.S. Patent are baked bar-like shaped ceramics and therefore, there occurs a problem when an electrode for imparting an applied voltage to the PTC ceramics is provided. When a current flows from the opposite ends of the bar to generate heat, even if only the central portion of the roller with respect to the axial direction thereof falls in temperature by reason of the heat therein being taken up by paper and toner, the supply of power to that portion is not effected, thereby causing unsatisfactory fixation. This is because the other portion of the roller is at a predetermined temperature or higher and therefore the end portions of the PTC ceramics opposed to each other do not pass the current therethrough due to their self temperature control. Conversely, if an attempt is made to flow a current by applying a voltage from the front surface and back surface of the bar-like shaped ceramics, when fixation is effected continuously, unsatisfactory fixation will be caused because the heat generation of the PTC ceramics is small.

Thus, an electrode is desired which can uniformly maintain the surface temperature of the heating-fixing roller in a practical range. A heating-fixing roller is also desired which will not cause unsatisfactory fixation even for recording materials of different sizes and can accomplish stable fixation.

On the other hand, if an electrode is provided on the surface of ceramics having a PTC characteristic, the ceramics will locally increase in temperature even to 500° C.-1000° C. during the setting of the electrode and therefore, cracks will occur in the ceramics. Heretofore, the ceramics used in the field of fixation have consisted of a binder mixed with powder but are so tattery that they cannot maintain their shape, and it has been unavoidably necessary to bake the ceramics to obtain their shape. Accordingly, the inventor has thought that it is necessary that the conventional ceramics, before being baked, can be readily changed in shape. The conventional ceramics, before being baked, have contained a binder of several % or less relative to the raw powder material and have been undeformable.

Also, the conventional PTC ceramics have sometimes been poor in heat conversion efficiency relative to the power supply and no clear explanation of this problem has been made.

SUMMARY OF THE INVENTION

In view of the above-noted problems, it is an object of the present invention to provide a heating-fixing roller which enables an electrode to be provided in a state in which no crack occurs on a heat-generating layer having a PTC characteristic.

In view of the above-noted problems, it is another object of the present invention to provide a heating-fixing roller in which an electrode capable of forming a uniform heating state which is not affected by recording materials of various sizes is provided on a heat-generating layer having a PTC characteristic.

In view of the above-noted problems, it is still another object of the present invention to provide a heating-fixing roller in which the heat efficiency of a heat-generating layer having a PTC characteristic is improved.

It is yet still another object of the present invention to provide a fixing device having said heating-fixing roller.

Other objects of the present invention will become apparent from the following detailed description taken in conjunction with the accompanying drawings.

DESCRIPTION OF THE PREFERRED EMBODIMENTS

Figure 1:
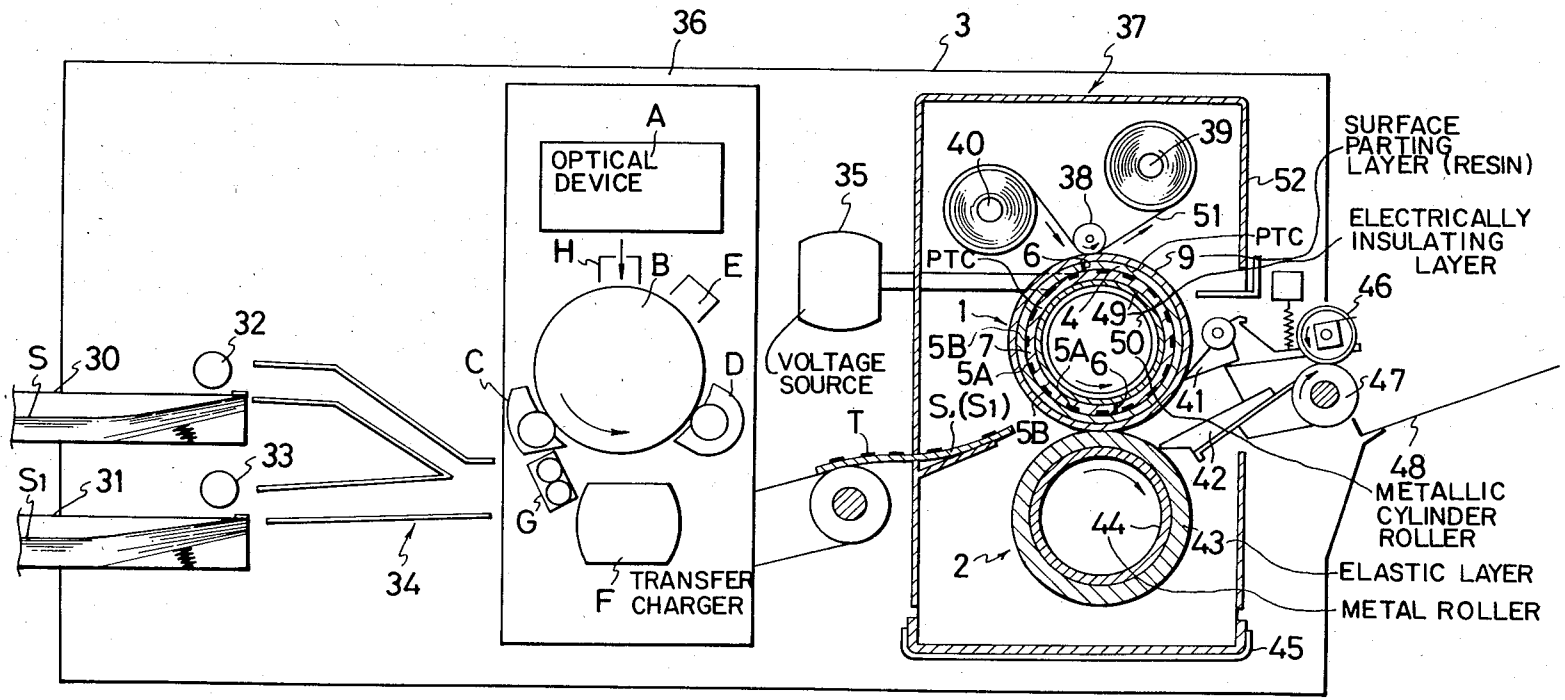
FIG. 1 illustrates the entire construction of an embodiment of the present invention.

An embodiment suited for the objects of the present invention and an example of the application thereof will become apparent from the description of FIG. 1.

In FIG. 1, reference numeral 36 designates the block of image forming means, and it shows that the construction contained therein includes one of various image forming means such as a popular facsimile, a laser printer and a printing machine.

For the sake of convenience, means A–H for forming a visualized image by the electrophotographic method are shown as an example of the image forming means 36.

B designates a photosensitive drum having a photosensitive layer, as an example of the image bearing member. The photosensitive drum B is rotated in the direction of the arrow by the drive force of a drive source (not shown) in response to a copy signal and is pre-discharged by a pre-discharging charger, not shown. The photosensitive drum B is then charged by a primary charger E, and then is subjected to secondary discharging by a secondary charger H. On the other hand, simultaneously therewith, the image of an original is scanned by an optical device A including an optical member and optical member moving means, whereby the photosensitive drum B is exposed to the image. An electrostatic latent image is them formed on the drum B by the drum being subjected to whole surface exposure, not shown. This latent image is developed into a visible image by a developing device C, and is rotated with the drum B to come to a transfer charger F.

On the other hand, recording materials S and S1 of different widthwise sizes are fed one by one from cassettes 30 and 31 by conveyor rollers 32 and 33 and are moved along a guide member 34, and are conveyed toward the drum B to receive the visible image thereon while being timed by register rollers G. At this time, the recording materials S and S1 and charged to the polarity opposite to the polarity of the visible image from the back thereof by the transfer charger F, whereby the visible image is transferred onto the recording materials S and S1. Thereafter the photosensitive drum B has its surface cleaned by cleaning means D and becomes ready for the next cycle of copying.

On the other hand, the recording materials S and S1 bearing the visible image T thereon are separated from the photosensitive drum B and are transported to a fixing device 37.

A heating-fixing roller 1 has a construction which will later be described, and cooperates with a pressure roller 2 to convey the recording materials S and S1 while holding the recording materials therebetween. At this time, the thermoplastic powder developer (hereinafter referred to as the toner) of the visible image which is in contact with the fixing roller 1 is melted and pressed, whereby the toner is heated and fixed on the recording materials.

The pressure roller 2 comprises a rigid metallic roller 44 and a thick coating 43 of offset preventing elastic material such as silicone rubber provided on the peripheral surface of the roll 44. The fixing roller 1 and the pressure roller 2 are urged against each other so that the elastic coating 43 is elastically deformed to thereby form a nip portion for fixing the image on the recording materials S and S1. The driving of these rollers 1 and 2 is such that the roller 1 is rotatively driven in the direction of arrow by a motor (not shown) provided in the body of the electrophotographic recording apparatus 3 and the roller 2 follows the rotation of the roller 1 due to a frictional force. A web 51 for cleaning the surface of the fixing roller 1 is urged against the peripheral surface of the fixing roller 1 by a pressing roller 38. The web 51 wound on a shaft 40 cleans the surface of the fixing roller whereafter it is taken up by a shaft 39 rotated by a drive force. The rollers 1, 2, 38 and the shafts 39, 40 have a width greater than the width of the recording materials S and S1 and are rotatably supported within a fixing device housing 52. Reference numeral 41 designates a separating pawl which bears against the fixing roller 1 to separate the recording material from the surface of the roller 1, and reference numeral 42 denotes a guide plate proximate to the pressure roller 2. Reference numerals 46 and 47 designate discharge rollers for discharging the recording mateiral conveyed between the separating pawl 41 and the guide plate 42 into a tray 48.

The above-described fixing device 37 is removably mountable with respect to the apparatus 3 by the outer frame 52 sliding relative to a rail fixed within the apparatus.

The heating-fixing roller 1 will now be described in detail.

As seen in FIGS. 1 to 4, the roller 1 is of a multi-layer construction. Reference numeral 50 designates a hollow metallic cylindrical roller which forms the base body of the roller 1. Reference numeral 49 denotes an electrically insulating layer provided on the metallic cylindrical roller 50. This insulating layer 49 makes an upper heat-generating layer 4 of PTC ceramics and an inner layer 7 of PTC ceramics electrically insulating with respect to the base body. The insulating layer 49 is provided to enhance the heat-generating efficiency of the PTC ceramics of the upper layer.

Figure 2:
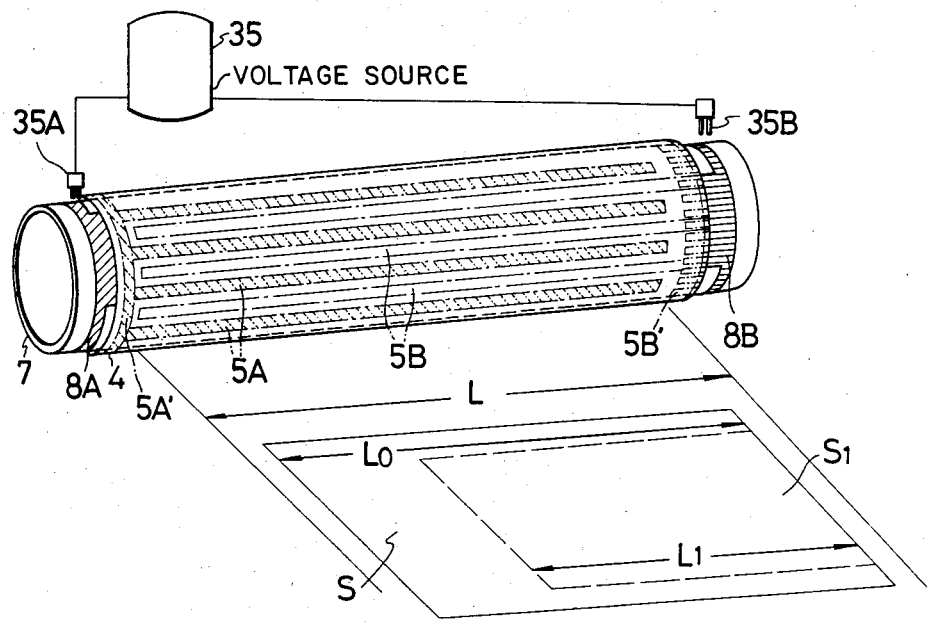
FIG. 2 is a perspective view of an embodiment of the heating-fixing roller of FIG. 1.

The inner layer 7, as seen in FIG. 2, is a cylindrical layer of PTC ceramics having a junction 6 and forming a cylinder. Conductors 8A and 8B are printed on the entire circumferences of the opposite end portions of the inner layer 7, and these conductors constitute electrodes for receiving a voltage applied from the apparatus 3.

The heat-generating layer 4 is a cylindrical layer of PTC ceramics provided as the upper layer of the inner layer 7 and forms a layer lower in resistance than the ceramics of the inner layer 7. Conductors 5A and 5B are alternately printed at predetermined intervals on the inner side of the layer 4. These conductors 5A and 5B form a lengthwise line-shaped pattern over the lengthwise direction of the heat-generating layer 4, and they are provided in such a manner that a conductor 5B and a conductor 5A are adjacent to each other between two conductors 5A and between two conductors 5B, respectively, with respect to the circumferential direction.

The interval between adjacent conductors 5A and 5B is constant, and the interval between the conductors 5A and the interval between the conductors 5B are also constant. It is preferable that such line-shaped conductors 5A and 5B at predetermined intervals be provided in an area L wider than at least the passage areas of the recording materials S and S1. The reason is that if the intervals between the conductors are constant, the PTC ceramics between the conductors can effect uniform heat generation with respect to the lengthwise direction of the roller.

The conductors 5A and 5B form electrodes, and a terminating conductor 5A' and a terminating conductor 5B' terminate the conductors 5A and the conductors 5B, respectively, so that the conductors 5A and the conductors 5B are opposite in polarity to each other. These terminating conductors 5A' and 5B' are provided on the opposite end portions of the heat-generating layer 4 over the entire inner peripheral surface thereof (see FIG. 2). Only these terminating conductors 5A' and 5B' are connected to the conductors 8A and 8B of the inner layer, thereby forming a power supply mechanism for the roller 1.

The junction 6 of the heat-generating layer 4 is opposed to the junction 6 of the inner layer 7 with a difference of 180° so that the former junction is not at the same position as the latter junction with respect to the circumference. It is effective to enhance the strength of the heating-fixing roller that these junctions 6 do not overlap each other. The heating-fixing roller has on the surface of the heat-generating layer 4 a surface parting layer 9, for example, a layer formed of a high molecular substance such as PFA resin, FEP resin or PTFE resin, to prevent the fusion of the toner from the image T.

Figure 3:
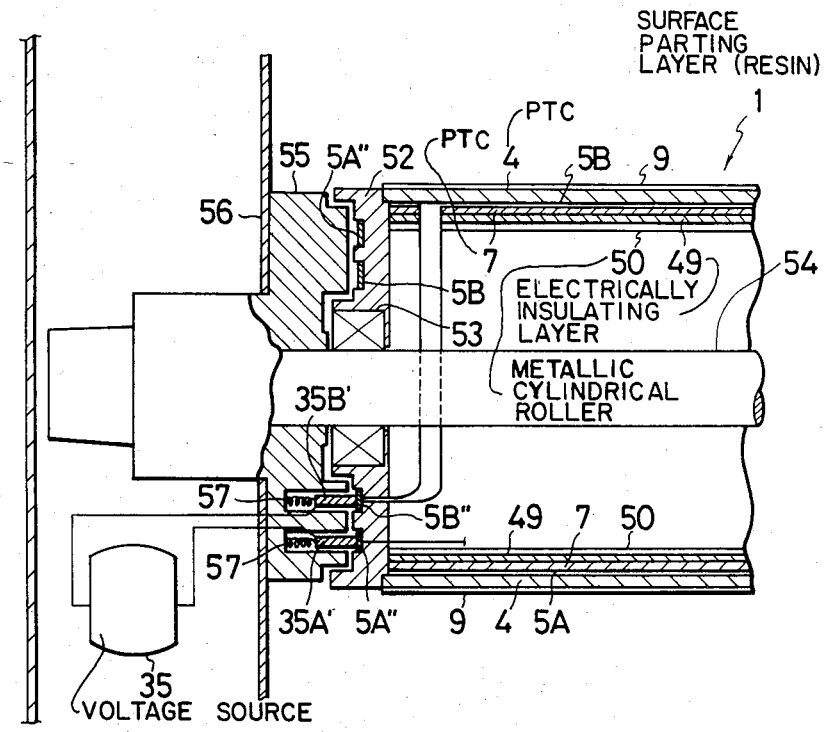
FIG. 3 is an axial cross-sectional view showing the essential ions of the heating-fixing roller of FIG. 1.

Reference numeral 35 designates a voltage applying device for applying a voltage between all conductors 5A and 5B and causing a current to flow thereto. The voltage applying device 35 has power supply brushes 35A and 35B for supplying a power to the two poles (or power supply filaments 35A' and 35B' as shown in FIG. 3). In FIG. 2, the brushes 35A and 35B bear against the conducturs 8A and 8B, respectively.

As described above, on the roller surface corresponding to the width $L_0$ of the recording material S and the width $L_1$ of the recording material S1 ($L_0 > L_1$), there are successively provided the conductors 5A and 5B of the electrodes different from each other with respect to the circumferential direction and therefore, the heat generation in the heat-generating layer can be effected in the circumferential direction. Thus, the temperature of the roller surface in the area corresponding to the widths of the recording materials falls, only the area in which the temperature has fallen is heated by the action of the reduction in resistance of the PTC ceramics present in that area. Accordingly, unnecessary temperature rise in the roller surface is prevented and the roller surface temperature distribution can be made uniform over the axial direction of the roller. Also, the substantially constant intervals between the conductors 5A and 5B lead to more preferable uniformity of temperature. Also, the alternate arrangement of the conductors 5A and 5B can achieve uniform temperature distribution in the circumferentical direction of the roller.

In FIG. 2, the surface layer 9, the insulating layer 49 and the base body roller 50 are not shown (although even the constrution of FIG. 2 provided with surface parting layer 9 is an example of the roller construction of the present invention), but the lengthwise cross-section of the roller can be understood from FIG. 3. In FIG. 3, the power supply filaments 35A' and 35B' described in connection with FIG. 2 are used and therefore, an adiabatic electrically insulating flange 52 is provided on one end of the roller, and ring-like terminating conductor rails 5A'' and 5B'' are provided on the outer surface of the flange 52 so as to depict two concentric circles about the shaft 54 of the roller 1. The conductors 5A and 5B are all electrically connected to the rails 5A'' and 5B'', respectively. Further, in FIG. 3, the shaft 54 is fixed to the base plate 56 of the apparatus and in addition, a bearing 53 for making the roller 1 rotatable relative to the shaft 54 is provided in the flange 52. The filaments 35A' and 35B' are connected to the voltage applying device 35 and also bear against the rails 5A'' and 5B'', respectively, with the aid of a pressure spring 57. The widths of the ends of the filaments 35A' and 35B' are smaller than the widths of the rails 5A'' and 5B'' and therefore, the filaments are in stable contact with the rails. Reference numeral 55 designates a shaft support containing the filaments and the pressure spring therein and fixed to the apparatus through a minute gap relative to the flange 52.

Figure 4:
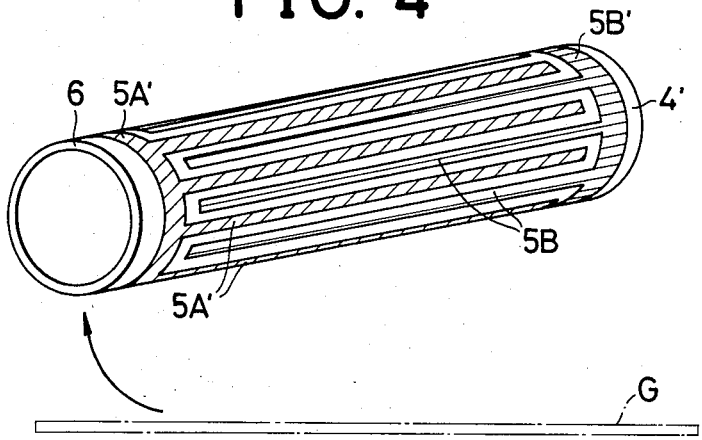
FIG. 4 a perspective view of another embodiment of the heating-fixing roller.
Figure 6:
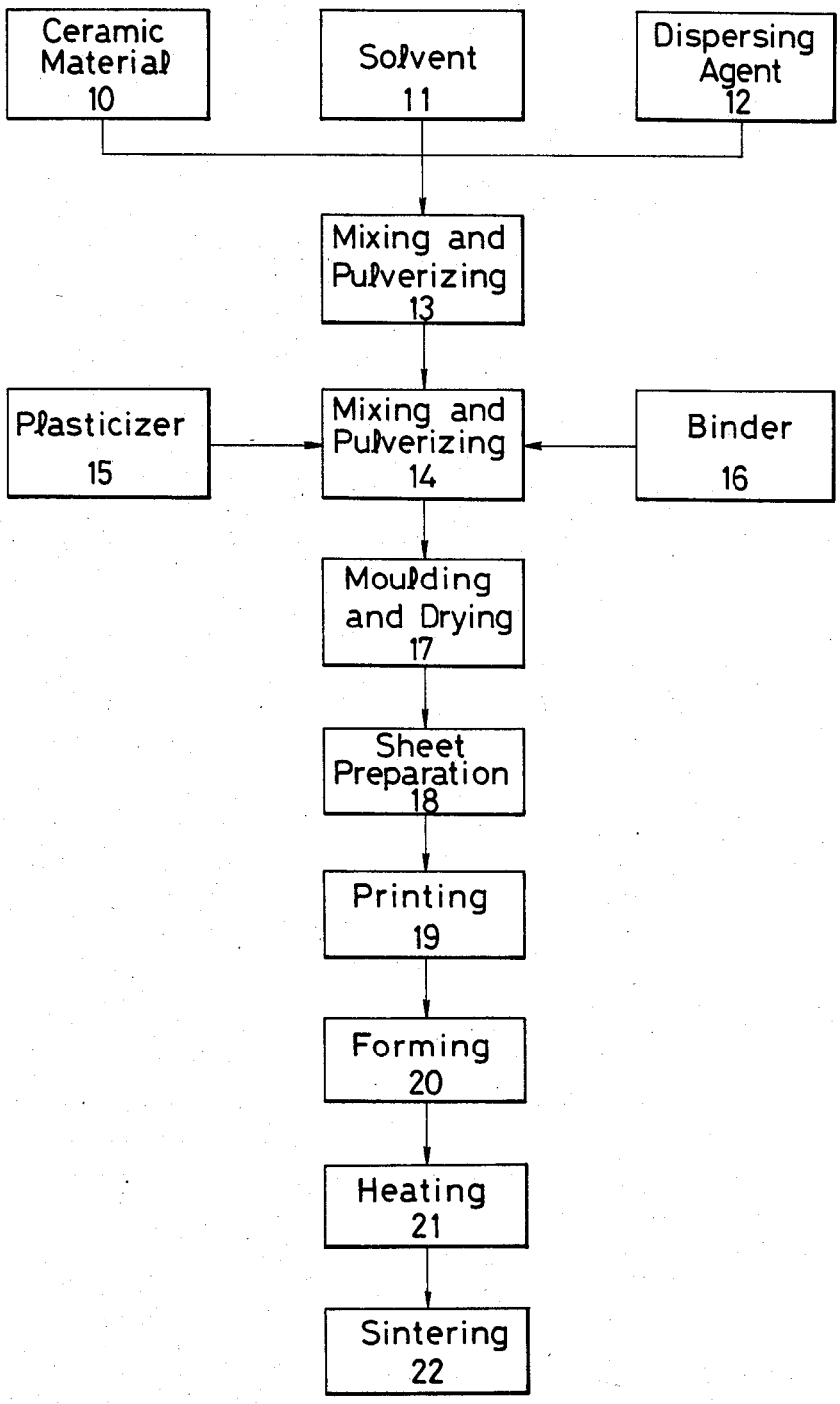
FIG. 6, is a flow chart for illustrating the manufacturing process of the present invention.

FIG. 4 and the manufacture flow chart of FIG. 6 will now be described.

A solvent 11 and a dispersing agent 12 are added to a ceramic material 10 of a material construction having a curie point by sintering, and the mixing and pulverizing step 13 is carried out. The ceramic material 10 has an additive element for semiconductorization (for example, an oxide of La, Ce, Nb, Ta, Bi, Sb or W) added to $BaCO_3$ and $TiO_2$ which are the raw materials of $BaTiO_3$ ceramics having the PTC characteristic, and further has a component for increasing the positive resistance temperature coefficient (an element such as Mn, Fe, Cu or Cr) and a component for expediting the semiconductorization and adjusting the particle diameter ($Al_2O_3$, $SiO_2$ or $TiO_2$).

In the present example, raw materials are mixed so as to provide a construction ratio of 16 parts of barium titanate to 9 parts (or less) of lead titanate, thereby obtaining a heat-generating layer whose curie point is 100° C.–250° C. As the solvent 11, use is made of Trichlene, alcohol, ethyl acetate, toluene, aceton, MEK, water or the like, and as the dispersing agent 12, use is made of fish oil, octyl amine, glyceryl monooleate, glyceryl trioleate or the like.

Further, a plasticizer 15 and a binder 16 are added and again, sufficient mixing and pulverzing 14 is effected, and then moulding and drying 17 is effected and a green sheet is prepared at step 18. The greeen sheet contains 10–20% binder therein and is flexible. As the plasticizer 15, use is made of polyethylene glycol, DBP (dibutyl phthalate), DOP (dioctyl phthalate), SAIB (stearic acid isobutyral), glycerine or the like, and as the binder 16, use is made of cellulose acetate, polyacrylate, PVA (polyvinyl alcohol), PVB (polyvinyl butyral), EVA (ethyl vinyl alcohol), PVAc (polyvinyl acetate) or the like. In this manner, a green sheet having a thickness of 0.5–2 mm is prepared, whereafter high temperature sintering conductive paste, preferably, tungsten powder paste, is printed 19 in the form of comb teeth as shown on the sheet by the screen printing method to thereby form the aforedescribed conductors 5A, 5B, 5A' and 5B'. In their printed state, the conductors are in the form of a sheet as indicated by broken line in FIG. 4 and, during the printing, they are subjected to heat of 200° C. or less which is much lower than the ceramics baking temperature of 500° C.–1500° C.

If the green sheet on which the conductors have been thus pattern-printed is placed so that the conductors lie on the inner surface, there will be provided the heat-generating layer 4 of FIG. 1, and if the green sheet is placed so that the conductors lie on the outer surface, there will be provided the heat-generating layer 4' of FIG. 4. In any case, the sheet is formed at step 20 into a cylindrical shape.

This cylindrical formation does not require any extraneous pressure imparting means and therefore, the interior of this formation is free of the influence of residual stress, strain or the like.

The cylindrical formation thus formed is heated 21 to thereby remove the binder 16 remaining therein. Subsequently to this heating, the cylindrical formation is increased in temperature at 200° C.–400° C. per hour and is sintered 22 at about 1300°–1400° C. in a reducing atmosphere for two hours.

Under the conditions of such high temperature and reducing atmosphere, the ceramics contracts to obtain the PTC characteristic. At the same time the patterned conductors 5A, 5B, 5A' and 5B' are also exposed to the high temperature and therefore, the conductors which have been printed and unstable relative to the ceramics are intimately fixed to the ceramics during this baking. If this baked body is cooled at 100° C.–200° C. per hour, there will be prepared the roller as shown in FIG. 4.

In FIG. 1, the roller has the inner surface 7 and therefore, this manufacturing method is supplemented. The inner surface 7, like the heat-generating layer 4, is provided by preparing a green sheet of ceramics at 18, and conductors 8A and 8B as pattern electrodes are printed at step 19 in the form of lines on the opposite ends of one surface of the sheet. The heat-generating layer 4 is superposed on the sheet having the conductors 5A, 5B, etc. pre-printed thereon as previously described so that the conductors 8A and 8B of the sheet of the inner layer 7 are in contact with the conductors 5A' and 5B'. The pair of sheets superposed one upon the other are formed at 20 into a cylindrical shape so that the sheet on which the conductors 8A and 8B are printed lies inside and that the seams of these sheets do not overlap each other. Thereafter, the aforedescribed heating 21 and sintering 22 are effected. Thus, there is obtained a form of roller in which the heat-generating layer 4 and the inner surface 7 are made integral with each other.

Generally, ceramics contracts by baking, and partial irregrlarity of this contraction leads to crack or qualitative irregularity and further to dimensional irregularity. Such partial irregularity of the contraction results from the mixing irregularity of the raw materials or the residual stress or residual strain by the pressure during the forming.

Heretofore, cracking or qualitative irregularity has occurred during the baking, but in the present method, the ceramics is not subjected to the influence of the extraneous pressure during the forming and as a result, there is no residual stress and residual strain in the formed body and therefore, said roller can be made without any cracking or qualitative irregularity occuring thereto.

Thus, a PTC ceramic roller having the PTC characteristic is manufactured. This roller is printed with electrodes also simultaneously with sintering and eliminates the necessity of printing the electrodes later and therefore, the occurrence of cracking by the heat shock during the printing of the electrodes or the occurrence of dimensional deformation can be prevented.

FIG. 2 is also a perspective view of another embodiment usable as the heating-fixing roller of the present invention, and in this case, a roller having a thickness of 0.5 mm–4 mm (the thickness of the two sheets 4 and 7 cemented together) and a diameter up to the order of about 30$\phi$ can be made. Also, the dimensions of the rollers after baking is of the accuracy of $\pm$0.3–0.5% for a roller of about 10$\phi$.

In the embodiment shown in FIGS. 1 and 2, the electrodes (5A, 5A', 5B', 5B) are not exposed to the surface, and this embodiment has the advantages that there is no uneveness of the electrode portion and that there is no diffusion of heat into the air by the heat generation from the surface.

Figure 5:
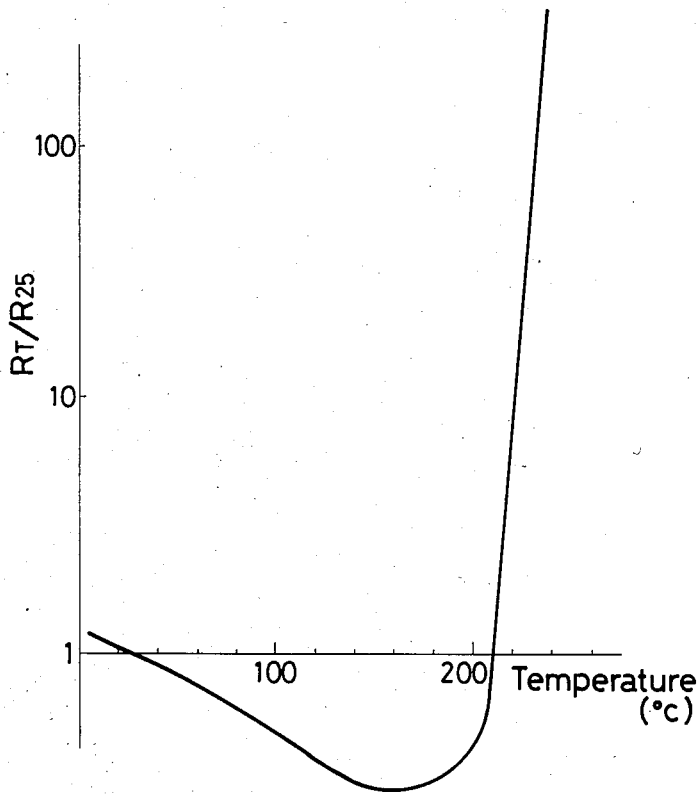
FIG. 5 is a graph showing the resistance variation curve of the heat-generating layer of the heating-fixing roller of the present invention.

The PTC characteristic of the roller 1 made by this method is shown in FIG. 5. In this Figure, the variation in temperature of the resistance by the present embodiment is made normal with resistance at 25° C. as the standard. The data in FIG. 5 uses Ba atoms replaced with Pb of 25% by weight, but in this case, the non-uniformity during baking by evaporation of Pb becomes liable to occur as the amount of replacement of Pb is increased and therefore, it is preferable that the amount of replacement of Pb be small.

By making PTC ceramics in this manner, it is not only possible to make a roller of small thickness, but also it is possible to make a roller of good dimensional accuracy having little strain with electrodes printed thereon at the same time. This PTC ceramic roller having its surface coated with fluorince resin was constructed as a toner image heating-melting member in electrophotography with bearings being provided at the end portions thereof, and the temperature characteristic thereof was measured as compared with a heating roller (a cylindrical member Sus (stainless steel) and a surface PTFE (polytetrafluoroethylene) coat both having a thickness of 25$\pm$5$\mu$) using the conventional halogen heater. The result is shown in Table 1 below.

TABLE 1

| Diameter | Thickness | Rising time to 180° C. | Max. and Min. temperature distribution for l = 300 mm |
|---|---|---|---|
| Present Invention Roller of diameter 20 | 1 mm | 10 sec. | 15° C. |
| Present Invention Roller of diameter 20 | 2 mm | 15–20 sec. | 10° C. |
| Prior Art Halogen heater | 2 mm | 105 sec. | 20° C. |

As shown in Table 1, there were obtained rollers which were good in rising characteristic and temperature distribution.

In the conventional roller of good heat conductor simply heated by bar-like PTC ceramics, the PTC ceramics itself can rise to 180° C. in 20–30 seconds, but a time of 90–100 seconds is required for the surface of the fixing roller to reach the order of 180° C. and in addition, the temperature distribution of the surface is considerably non-uniform, and thus there was found a great difference from the present invention.

By forming PTC ceramics material into a sheet, printing electrodes on the surface thereof, and thereafter forming the sheet into a cylindrical shape and sintering it to thereby make a PTC ceramic roller as described above, there are achieved the following effects:

1. It becomes possible to make a PTC roller without injuring the dimensional accuracy thereof and without producing cracks and qualitative irregularity, and thus a PTC ceramic roller of good heat-generating efficiency can be made;

2. By forming electrodes simultaneously with the baking of the ceramic roller, the dimensional deformation or cracking resulting from heat shock during electrode printing can be prevented and a roller of low cost can be provided; and 3. By using the roller as a heating roller in a fixing device for electrophotography, there can be provided a melting device which is good in rising characteristic and capable of quick starting in which the heating time until a predetermined temperature is reached is short.

Also, the fact that different electrodes are successively arranged on the peripheral surface (one of the inner surface and the outer surface) of the roller leads to obtainment of great heat generation. If the distance between the electrode conductors 5A and 5B is d and the number of the conductors is n and the parallel length of the conductors 5A and 5B is l and the resistivity per unit length is $\sigma_S$, the resistance of the layer is $$R = \sigma_s \times \frac{d}{l} \times n$$

and to obtain the whole amount of generated heat at 1 KW, if l=300 mm and the applied voltage is 100 V, then R=10 Ω. That is, when said amount of generated heat is to be obtained by said pattern electrodes, if $\sigma_s$ is 10Ω/mm, d and n may be set so that $d(\text{mm})\times n=300(\text{mm})$, and this leads to the advantage that designing is easy and the practical range can be enlarged. Conversely, if the unit resistance, the distance d and the number n of the conductors are varied, there will be obtained a greater amount of generated heat. Consequently, the fixationability when an unfixed toner image is fixed can be expected to be good in quality.

Even if discrete electrodes are provided on the outer surface and the inner surface of the heat-generating layer 4 and this layer is caused to generate heat, the resistance thereof is represented by $$R=\frac{P}{2\pi l}\,l_n\,b/a$$

(a is the inner diameter of the inner surface electrode, b is the outer diameter of the outer surface electrode, and $\rho$ is the ratio resistance per unit length) and therefore, if an attempt is made to apply a limited voltage 100 V and obtain 1 KW, the resistance thereof is $l_n\ b/a=200\rightarrow b/a=e^{200}$ when $l=300$ mm and $\sigma=10\Omega/\text{mm}$ and $R=10\Omega$ and therefore, the attempt cannot be realized. Also, even if an attempt is made with a voltage of 10 V or 1 V applied, $b/a=e^2$ and $b/a=e^{0.02}\approx 1.02$ and therefore, the attempt becomes impossible or a very large transformer is required, and this means a great demerit in practice.

In the above-described embodiment, $(d\times n)$ should preferably be $18<(d\times n)\leqq 42$ when viewed on the basis of the foregoing mathematical expression. Also, the resistance of the PTC ceramics may suitably be 6Ω–50Ω, and preferably be 14Ω or less when the heat generation of 1.5 KW or less and the heat generation of 700 W or more during the rising are taken into account.

Where both of the inner layer 7 and the heat-generating layer 4 are PTC heat-generating layers as in the embodiment of FIG. 1, it will be advantageous in shortening the required time for rising and effective in preventing the reduction in heat during continuous fixation to make the resistance of the heat-generating layer 4 which is the outer layer smaller than the resistance of the inner layer 7. Also, the provision of a plurality of PTC heat-generating layers is effective in making the temperature distribution of the surface of the fixing roller more uniform.

It is preferable to provide a parting layer on the surface of the heating-fixing roller, and the layers 49, 50 and 9 of FIG. 1 may be provided by any method, and the layers 49 and 50 which provide inner layers may be electrically insulating layers of a material such as ceramics which can provide sufficient strength.

The heating-fixing roller referred to in the present invention includes a fixing roller which contacts an unfixed toner image, a roller adapted to cooperate with a fixing roller to hold a recording material therebetween and convey it, a roller for heating the fixing roller, etc.

The present invention bears its novel and sufficient effect not only in a heating-fixing roller but also in a fixing device including a pressure roller used with the heating-fixing roller.

Said voltage applying means 35 is composed of the material in which current can flow, and the current to be applied is either AC or DC, when the current to be applied is AC, the polarity of the conductor is alternately varied between the positive and the negative. And claims cover the above phenomenon.

I claim:

1. A heating-fixing roller having over an axial direction thereof a heat-generating layer formed through the step of mixing a raw material capable of obtaining a positive temperature coefficient of resistivity characteristic by sintering and a binder for holding said raw material and forming an unsintered annular substrate and the step of providing an electrode to which an applied voltage is supplied on said mixture during said forming step, and thereafter through the step of sintering said unsintered annular substrate on which said electrode is formed, said heat-generating layer having a positive temperature coefficient of resistivity characteristic after said sintering and having said electrode formed on the surface thereof.

2. A heating-fixing roller according to claim 1, further having an offset preventing layer on a surface thereof.

3. A heating-fixing roller according to claim 2, wherein said heating-fixing roller conveys a recording material between it and another roller provided in opposed relationship therewith to fix an unfixed toner image on the recording material.

4. A heating-fixing roller according to claim 1, wherein said electrode is provided by forming the mixture of said raw material and said binder into a sheet-like shape and thereafter providing said electrode on a surface of said sheet.

5. A heating-fixing roller according to claim 4, wherein said electrode has conductors spaced apart from one another with respect to the circumferential direction of said heating-fixing roller and successively arranged and longer than the width of the largest recording material, said conductors extending over the axial direction of said roller.

6. A heating-fixing roller according to claim 4, wherein said conductors form electrodes different in polarity from the adjacent conductors, and a portion of the sintered heat-generating layer of a positive temperature coefficient of resistivity characteristic which is between a pair of electrodes of different polarities over the lengthwise direction of said roller effects uniform heat generation without being affected by the position thereof with respect to the axial direction of said roller.

7. A heating-fixing roller according to claim 6, wherein a constant interval is provided between said pair of electrodes of different polarities with respect to the circumferential direction.

8. A heating-fixing roller according to claim 6, wherein said electrode is provided on an inner peripheral surface of the provided heat-generating layer.

9. A heating-fixing roller according to claim 6, wherein the resistance of said heat-generating layer is more than 6Ω and not more that 50Ω.

10. A heating-fixing roller according to claim 9, wherein the resistance of said heat-generating layer is not more than 14Ω.

11. A heating-fixing roller according to claim 1, wherein a heat-generating portion formed by said heat-generating layer is electrically insulated from the outside and inside of said heat-generating portion with respect to the direction of thickness of said roller.

12. A heat-fixing foller roller conveying a recording material sandwiched between said roller and another roller for fixing an unfixed image on the recording material which has a variety of different widthwise sizes, said heat-fixing roller comprising a cylindrical heat-generating layer having obtained a positive temperature coefficient of resistivity characteristic by sintering, and a pair of electrodes secured to the surface of said heat-gnerating layer after said sintering, said pair of eletrodes having conductors forming a positive pole and conductors forming a negative pole alternatively with respect to the circumferential direction of said cylindrical heat-generating layer, said pair of electrodes being provided over more than the width of the largest recording material in the lengthwise direction of said heat-generating layer, whereby a portion of said heat-generating layer of a positive temperature coefficient of resistivity characteristic which is between the conductors of different polarities renders uniform the surface temperature with respect to the lengthwise direction of said heat-fixing roller.

13. A heating-fixing roller according to claim 11, wherein a substantially constant interval between said pair of conductors of different polarities is provided with respect to the circumferential direction of said heat-generating layer.

14. A heating-fixing roller according to claim 11, wherein the resistance of said heat-generating layer is more than 6Ω and less than 50Ω.

15. A heating-fixing roller according to claim 14, wherein the resistance of said heat-generating layer is not more than 14Ω.

16. A heating-fixing roller according to claim 11, wherein said heat-generating layer is formed into a cylindrical shape after said pair of electrodes have been provided on a raw sheet comprising a binder mixed with a raw material having not more than 9 parts of lead titanate relative to 16 parts of barium titanate, and is further sintered in a reducing atmosphere.

17. A heating-fixing roller according to claim 11, wherein said pair of electrodes are provided on an inner surface of said heat-generating layer.

18. A heating-fixing roller according to claim 17, wherein said heating-fixing roller has an inner layer which is in intimate contact with said heat-generating layer, said inner layer has conductors spaced apart from each other at opposite ends thereof, the conductor which provides the positive pole of said heat-generating layer is connected to a conductor of the inner layer and the conductor which provides the negative pole of said heat-generating layer is connected to another conductor of the inner layer, and the conductors of said inner layer are a voltage receiving portion for receiving an applied voltage from outside.

19. A heating-fixing roller according to claim 18, wherein the interval between said pair of conductors of different polarities is constant with respect to the circumferential direction of said heat-generating layer.

20. A heating-fixing roller according to claim 19, wherein the resistance of said heat-generating layer is more than 6Ω and not more than 14Ω.

21. A heating-fixing roller according to claim 12, wherein a heat-generating portion formed by said heat-generating layer is electrically insulated from the outside and inside of said heat-generating portion with respect to the thickness of said roller.

22. A heating-fixing roller according to claim 12, wherein said pair of electrodes are provided on the surface of a heat-generating substrate before the sintering of said heat-generating layer and made integral with said heat-generating layer before the sintering thereof.

23. A heating-fixing roller having a first and a second cylindrical heat-generating layer having obtained a positive temperature coefficient of resistivity characteristic by sintering, said first heat-generating layer being outside said second heat-generating layer, the resistance of said first heat-generating layer being smaller than the resistance of the second heat-generating layer corresponding thereto, and a pair of electrodes provided between said first and said second heat-generating layer to apply a voltage to said heat-generating layers.

24. A heating-fixing roller according to claim 23, wherein said pair of electrodes have conductors forming a positive pole and conductors forming a negative pole alternately with respect to the circumferential direction of said cylindrical heat-generating layers, and said pair of electrodes are provided over more than the width of a recording material in the lengthwise direction of said heat-generating layers, whereby a portion of said heat-generating layers of a positive temperature coefficient of resistivity characteristic which is between a pair of conductors of different polarities uniformizes surface temperature with respect to the lengthwise direction of said heating-fixing roller.

25. A heating-fixing roller according to claim 23, wherein said pair of electrodes are provided on said first heat-generating layer before being sintered and secured to said first heat-generating layer during the sintering thereof.

26. A heating-fixing roller according to claim 21, wherein a heat-generating portion formed by said first and second heat-generating layers is electrically insulated from the outside and inside of said heat-generating portion with respect to the direction of thickness of said roller.

* * * * *

UNITED STATES PATENT AND TRADEMARK OFFICE

CERTIFICATE OF CORRECTION

PATENT NO. : 4,628,183

DATED : December 9, 1986

INVENTOR(S) : HIROSHI SATOMURA

It is certified that error appears in the above-identified patent and that said Letters Patent is hereby corrected as shown below:

Column 9, line 7, change "fixationability" to --fixation ability--;

line 14, change "P" to --σ--.

Column 10, line 38 (Claim 6, line 3), delete "the";

line 63 (Claim 12, line 1), delete "foller".

Column 11, line 5 (Claim 12, line 11), change "alternatively" to --alternately--.

Signed and Sealed this

Tenth Day of March, 1987

*Attest:*

*Attesting Officer*

DONALD J. QUIGG

*Commissioner of Patents and Trademarks*